US007744433B2

(12) United States Patent
Ozaki et al.

(10) Patent No.: US 7,744,433 B2
(45) Date of Patent: Jun. 29, 2010

(54) JET-PROPULSION PERSONAL WATERCRAFT

(75) Inventors: Atsufumi Ozaki, Kobe (JP); Satoru Watabe, Akashi (JP)

(73) Assignee: Kawasaki Jukogyo Kabushiki Kaisha, Kobe-shi (JP)

( * ) Notice: Subject to any disclaimer, the term of this patent is extended or adjusted under 35 U.S.C. 154(b) by 163 days.

(21) Appl. No.: 12/117,602

(22) Filed: May 8, 2008

(65) Prior Publication Data

US 2008/0280512 A1 Nov. 13, 2008

(30) Foreign Application Priority Data

May 9, 2007 (JP) ..... 2007-124399

(51) Int. Cl.
*B63H 21/22* (2006.01)

(52) U.S. Cl. ..... 440/1

(58) Field of Classification Search ..... 440/1
See application file for complete search history.

(56) References Cited

U.S. PATENT DOCUMENTS 6,231,410 B1 * 5/2001 Bernier et al. ..... 440/40
6,709,302 B2 3/2004 Yanagihara
7,160,158 B2 * 1/2007 Kinoshita ..... 440/1

* cited by examiner

*Primary Examiner*—Stephen Avila
(74) *Attorney, Agent, or Firm*—Alleman Hall McCoy Russell & Tuttle LLP

(57) ABSTRACT

A jet-propulsion personal watercraft includes an engine configured to generate a driving power for generating a propulsion force to propel the watercraft, an engine speed changing system configured to be able to change an engine speed of the engine, a determiner configured to determine whether or not to execute control for effectively steering the watercraft at start of deceleration, and an engine controller configured to control the engine speed changing system based on information received from the determiner. The engine controller is configured to, when the determiner determines that the control for effectively steering the watercraft should not be executed, control the engine speed changing system so that a decrease rate of the engine speed immediately after the determination is smaller than a decrease rate of the engine speed in a case where the determiner determines that the control for effectively steering the watercraft should not be executed.

16 Claims, 11 Drawing Sheets

- SIGN (−) INDICATES THROTTLE VALVE ROTATES IN CLOSING DIRECTION
- SIGN (+) INDICATES THROTTLE VALVE ROTATES IN OPENING DIRECTION

JET-PROPULSION PERSONAL WATERCRAFT

TECHNICAL FIELD

The present invention relates to a jet-propulsion personal watercraft configured to eject a water jet by an engine driving power to generate a propulsion force for propelling the watercraft.

BACKGROUND ART

In recent years, jet-propulsion personal watercraft (PWC) have been widely used in leisure, sport, rescue activities, and the like. The watercraft is typically equipped with an engine in an engine room in an inner space defined by a hull and a deck forming a body. The engine drives a water jet pump, which pressurizes and accelerates water sucked from a water intake generally provided on a hull bottom surface and ejects it rearward from an outlet port. As the resulting reaction, the watercraft is propelled forward.

For example, when making such a watercraft approach a position parallel to a shoreline, a driver must steer a steering handle while manipulating a throttle lever to control a propulsion force for turning the body. A conventional jet-propulsion personal watercraft is equipped with an actuator to restrict a closed position of a throttle valve subjected to a force applied from a return spring in a direction to close the throttle valve. In this watercraft, even when the throttle lever is operated to cause the throttle valve to be moved to a fully closed position during driving, the actuator restricts a closing operation of the throttle valve immediately before an engine speed reaches an idling engine speed so that the engine speed is maintained slightly higher than the idling engine speed for a certain time period. This makes it possible to delay time when the engine speed reaches the idling engine speed. As a result, the watercraft can be steered effectively for a longer time period.

However, in the above described conventional jet-propulsion personal watercraft, when the driver operates the throttle lever to close the throttle valve, the throttle valve is quickly closed under the force applied from the return spring up to a position at which the actuator restricts the closing operation of the throttle valve and then the actuator abruptly restricts the closing operation of the throttle valve. Although the driver has operated the throttle lever to close the throttle valve, the driver feels a slight acceleration operation after a lapse of some time after start of the deceleration.

SUMMARY OF THE INVENTION

The present invention addresses the above described conditions, and an object of the present invention is to provide a jet-propulsion personal watercraft which is capable of being effectively steered for a longer time period in a deceleration state of the watercraft, without making a driver feel driving discomfort.

According to one aspect of the present invention, there is provided a jet-propulsion personal watercraft comprising an engine which is configured to generate a driving power for generating a propulsion force to propel the watercraft; an engine speed changing system which is configured to be able to change an engine speed of the engine; a determiner configured to determine whether or not to execute a control for effectively steering the watercraft at a start of deceleration of the watercraft; and an engine controller configured to control the engine speed changing system based on information received from the determiner; wherein the engine controller is configured to, when the determiner determines that the control for effectively steering the watercraft should be executed, control the engine speed changing system to output a command to lower the decrease rate of the engine speed. In this manner the engine speed changing system may be controlled so that a decrease rate of the engine speed immediately after the determination is smaller than a decrease rate of the engine speed in a case where the determiner determines that the control for effectively steering the watercraft should not be executed.

In such a configuration, since the control for making the decrease rate of the engine speed smaller to effectively steer the watercraft is started immediately after the determination at the start of deceleration of the watercraft, a driver does not feel a slight acceleration state after a lapse of some time after the start of the deceleration. This makes it possible to provide a sufficiently long time period during which the watercraft is effectively steered in the deceleration state without making the driver feel driving discomfort.

The determiner may include an input detector which is configured to be able to detect an operated state of an input device with which a driver performs an operation to increase or decrease the engine speed, and a driving power output detector configured to be able to detect a driving power output of the watercraft. In a first detection, the input detector may detect that the input device has been operated by the driver in a direction to decrease the engine speed, with a change rate which is not smaller than a first threshold, up to a position which is smaller than a second threshold; and the driving power output detector detects that the driving power output is not smaller than a third threshold. In a second detection, the input detector may detect that the input device has been operated by the driver in the direction to decrease the engine speed, with the change rate which is not smaller than the first threshold up to the position smaller than the second threshold, and the driving power output detector detects that the driving power output is smaller than the third threshold. The determiner may determine that the control for effectively steering the watercraft should not be executed when the second detection occurs and that the control for effectively steering the watercraft should be executed when the first detection occurs. It should be noted that the input detector may directly or indirectly detect the operated state of the input device. As used herein, the driving power output includes the engine speed, a vehicle speed, etc.

In such a configuration, when the input detector detects that the input device has been operated by the driver in the direction to decrease the engine speed, with the change rate which is not smaller than the first threshold up to the position smaller than the second threshold, it may be determined that the driver has quickly operated the input device to decrease the engine speed. In this case, if the driving power output is not smaller than the third threshold (first detection), the vehicle speed of the watercraft is relatively fast and therefore the speed of the water jet for generating the propulsion force is likely to be slower than the vehicle speed of the body. So, to avoid the speed of the water jet becoming slower, it is necessary to execute the control for effectively steering the watercraft. In a case where the watercraft is decelerated in the state where the driving power output is not smaller than the third threshold, the engine speed changing system is controlled so that the decrease rate of the engine speed immediately after the driver's operation for deceleration is smaller than the decrease rate of the engine speed in the case where the watercraft is decelerated in the state where the driving power output is smaller than the third threshold. Since the control for making the decrease rate of the engine speed smaller is started immediately after the driver's operation for deceleration, the driver does not feel a slight acceleration state after a lapse of some time after the start of deceleration. This makes it possible to provide a sufficiently long time period during which the watercraft is effectively steered in the deceleration state of the watercraft without making the driver feel driving discomfort.

The engine controller may be configured to control the engine speed changing system so that an average decrease rate of the engine speed for 0.3 seconds immediately after the determiner determines that the control for effectively steering the watercraft should be executed is smaller than an average decrease rate of the engine speed for 0.3 seconds immediately after the determiner determines that the control for effectively steering the watercraft should not be executed.

Alternatively, the engine controller may be configured to control the engine speed changing system so that an average decrease rate of the engine speed in a time period from immediately after the determiner determines that the control for effectively steering the watercraft should be executed until the engine speed reaches 3000 rpm or lower is smaller than an average decrease rate of the engine speed for 0.3 seconds immediately after the determiner determines that the control for effectively steering the watercraft should not be executed.

In such a configuration, the deceleration immediately after the driver has operated the input device to decrease the engine speed is not so rapid as the deceleration in a case where the control is not executed, and it becomes possible to provide a sufficiently long time period during which the watercraft is effectively steered before the engine speed reaches the idling engine speed, while minimizing a fluctuation in the decrease rate of the engine speed.

The engine controller may be configured to control the engine speed changing system to set a time interval during which the decrease rate of the engine speed is maintained to be smaller than a decrease rate of the engine speed immediately after the determiner determines that the control for effectively steering the watercraft should be executed, when the driving power output detector detects that the engine speed is decreased to a fourth threshold higher than an idling engine speed from a time point when the determiner determines that the control for effectively steering the watercraft should be executed.

In such a configuration, since the time interval during which the engine speed is maintained before reaching the idling engine speed is set, it becomes possible to provide a sufficiently long time period during which the watercraft is effectively steered before the engine speed reaches the idling engine speed.

The engine controller may be configured to control the engine speed changing system so that a decrease rate of the engine speed immediately after a lapse of the time interval is smaller than a decrease rate of the engine speed immediately after the determiner determines that the control for effectively steering the watercraft should not be executed.

In such a configuration, it becomes possible to provide a longer time period during which the watercraft is effectively steered before the engine speed reaches the idling engine speed after the driver has performed the driver's operation for deceleration of the watercraft. In addition, since the engine speed continues to be decreased smoothly after the time interval, the driver does not feel two stages of deceleration.

The engine speed changing system may include an air-intake passage through which air taken in from outside is guided to the engine, a throttle valve configured to substantially open and close the air-intake passage based on an operation amount of an input device, a bypass passage connected to the air-intake passage so as to bypass the throttle valve, a bypass valve configured to substantially open and close the bypass passage, and a bypass valve driving device configured to drive the bypass valve. The engine controller may be configured to execute valve opening degree control for causing the bypass valve driving device to increase or maintain an opening degree of the bypass valve immediately after the determiner determines that the control for effectively steering the watercraft should be executed.

In such a configuration, even when the driver operates the input device for deceleration of the watercraft to close the throttle valve to an idling opening degree corresponding to an idling engine speed, the bypass valve is not closed but its opening degree is increased or maintained. Therefore, with a simple configuration, it becomes possible to provide a sufficiently long time period during which the watercraft is effectively steered before the engine speed reaches the idling engine speed.

The jet-propulsion personal watercraft may further comprise an engine speed sensor configured to detect an engine speed of the engine. The engine controller may be configured to cause the bypass valve driving device to gradually increase the opening degree of the bypass valve immediately after the determiner determines that the control for effectively steering the watercraft should be executed, then to execute a feedback control for the opening degree of the bypass valve for a specified time period to maintain the engine speed detected by the engine speed sensor at a predetermined value, and then to cause the bypass valve driving device to gradually decrease the opening degree of the bypass valve.

In such a configuration, since the feedback control enables the engine speed to be maintained at the predetermined value before reaching the idling engine speed, it becomes possible to provide a sufficiently long time period during which the watercraft is effectively steered before the engine speed reaches the idling engine speed.

In addition, since the bypass valve opening degree is gradually increased before the engine speed is decreased to the predetermined value, and gradually decreased after a lapse of the specified time period after the engine speed is maintained at the predetermined value, the driver can enjoy better driving feeling.

The engine speed changing system may include an air-intake passage through which air taken in from outside is guided to the engine, a throttle valve configured to substantially open and close the air-intake passage based on an operation amount of an input device, and an actuator configured to apply to the throttle valve a force in a direction to open the throttle valve. The engine controller may be configured to execute valve opening degree control for causing the actuator to apply to the throttle valve the force in the direction to open the throttle valve immediately after the determiner determines that the control for effectively steering the watercraft should be executed.

In such a configuration, even if the driver operates the input device for deceleration of the watercraft to close the throttle valve to the idling opening degree corresponding to the idling engine speed, the actuator applies to the throttle valve the force in the direction to open the throttle valve. Therefore, with a simple configuration, it becomes possible to provide a sufficiently long time period during which the watercraft is effectively steered before the engine speed reaches the idling engine speed.

The engine speed changing system may further include an ignition device configured to ignite an air-fuel mixture in the engine. The engine controller may be configured to execute ignition timing control for increasing an advancement angle value of igniting timing of the ignition device immediately after the determiner determines that the control for effectively steering the watercraft should be executed. The engine controller may be configured to terminate the valve opening degree control later than the ignition timing control is terminated.

In such a configuration, both the valve opening degree control and the ignition timing control are used to maintain the engine speed at which the watercraft is effectively steered. Since the valve opening degree control continues for some time after termination of the ignition timing control, the engine speed smoothly converges to the idling engine speed, and is appropriately inhibited from becoming lower than the idling engine speed.

The engine controller may be configured to gradually decrease the advancement angle value after a lapse of a specified time period after increasing the advancement angle value of the ignition timing of the ignition device immediately after the determiner determines that the control for effectively steering the watercraft should be executed.

In such a configuration, since the advancement angle value is gradually decreased when the ignition timing control is terminated, the driver can maintain better driving feeling.

The engine speed changing system may include an air-intake passage through which air taken in from outside is guided to the engine, and a throttle valve configured to substantially open and close the air-intake passage based on an operation amount of the input device. The input detector may include a throttle position sensor configured to detect an opening degree of the throttle valve. The first threshold may be a value indicating that the opening degree of the throttle valve detected by the throttle position sensor is changing at a rate of 5 degrees per 10 milliseconds in a direction to decrease the engine speed.

In such a configuration, it can be appropriately determined that the driver has quickly operated the input device to decelerate the watercraft.

The engine speed changing system may include an air-intake passage through which air taken in from outside is guided to the engine, and a throttle valve configured to substantially open and close the air-intake passage based on an operation amount of the input device. The input detector may include a throttle position sensor configured to detect an opening degree of the throttle valve. The second threshold may be a value indicating that the opening degree of the throttle valve detected by the throttle position sensor is 1 degree.

In such a configuration, it can be appropriately determined that the driver has quickly operated the input device so that the engine speed reaches the idling engine speed.

The driving power output detector may include an engine speed sensor configured to detect an engine speed of the engine. The third threshold may be a value indicating that an average engine speed of the engine is 4375 rpm.

In such a configuration, it can be appropriately determined whether the jet-propulsion personal watercraft is in a state in which the speed of the water jet for generating the propulsion force might be lower than the vehicle speed of the watercraft. The average engine speed may be an average value of the engine speed detected by the engine speed sensor which is obtained for 4 seconds that have passed from a current time point.

The engine speed changing system may include an air-intake passage through which air taken in from outside is guided to the engine, and a throttle valve configured to substantially open and close the air-intake passage based on an operation amount of the input device. The input detector may include a throttle position sensor configured to detect an opening degree of the throttle valve. The driving power output detector may include an engine speed sensor configured to detect an engine speed of the engine. The determiner may determine that the control for effectively steering the watercraft should not be executed, when the engine speed detected by the engine speed sensor is lower than 4000 rpm, the opening degree of the throttle valve detected by the throttle position sensor is larger than 1.5 degrees, and a change rate of the opening degree of the throttle valve is larger than a change rate with which the opening degree of the throttle valve changes at a rate of 1 degree per 10 milliseconds in a direction to increase the engine speed.

In such a configuration, since the speed of the water jet for generating the propulsion force is less likely to be slower than the vehicle speed of the body of the watercraft under the state where the control for effectively steering the watercraft is not executed, in a case where the throttle valve is opened and closed repeatedly within a short time and thereby the vehicle speed of the watercraft is relatively low, the control for effectively steering the watercraft is stopped so that the watercraft is smoothly decelerated.

According to another aspect of the present invention, there is provided a jet-propulsion personal watercraft comprising an engine which is configured to generate a driving power for generating a propulsion force to propel the watercraft, an air-intake passage through which air taken in from outside is guided to the engine, and a throttle valve configured to substantially open and close the air-intake passage, a bypass passage connected to the air-intake passage so as to bypass the throttle valve, a bypass valve configured to substantially open and close the bypass passage, a bypass valve driving device configured to drive the bypass valve, a determiner configured to determine whether or not to execute a control for effectively steering the watercraft at a start of deceleration of the watercraft, and an engine controller configured to control the bypass valve driving device based on information received from the determiner, wherein the engine controller is configured to, when the determiner determines that the control for effectively steering the watercraft should be executed, cause the bypass valve driving device to increase or maintain the opening degree of the bypass valve immediately after the determination.

In such a configuration, when the determiner determines that the control for effectively steering the watercraft should be executed at a start of deceleration of the watercraft, the opening degree of the bypass valve is increased or maintained although it is decreased under the state where the control is not executed, thereby suppressing the decrease rate of the engine speed to a small one. Since the control is started immediately after the driver's operation for deceleration of the watercraft, the driver does not feel a slight acceleration state after a lapse of some time after the start of the deceleration. This makes it possible to provide a sufficiently long time period during which the watercraft is effectively steered without making the driver feel driving discomfort.

The jet-propulsion personal watercraft may further comprise an ignition device configured to ignite an air-fuel mixture in the engine. The engine controller may be configured to execute ignition timing control for increasing an advancement angle value of ignition timing of the ignition device, immediately after the determiner determines that the control for effectively steering the watercraft should be executed.

With a simple configuration in which the ignition timing is advanced to increase an engine driving power, it becomes possible to provide a sufficiently long time period during which the watercraft is effectively steered before the engine speed reaches the idling engine speed.

According to a further aspect of the present invention, there is provided a jet-propulsion personal watercraft comprising an engine which is configured to generate a driving power for generating a propulsion force to propel the watercraft, an engine speed changing system which is configured to be able to change an engine speed of the engine, a determiner configured to determine whether or not to execute a control for effectively steering the watercraft at a start of deceleration of the watercraft, and an engine controller configured to control the engine speed changing system based on information received from the determiner. The engine controller may be configured to control the engine speed changing system so that a decrease rate of the engine speed is smaller than a decrease rate of the engine speed in a case where the control for effectively steering the watercraft is not executed, immediately after the determiner determines that the control for effectively steering the watercraft should be executed.

In such a configuration, when the determiner determines that the control for effectively steering the watercraft should be executed at the start of deceleration of the watercraft, the engine speed changing system is controlled to make the decrease rate of the engine speed smaller immediately after the driver's operation for deceleration of the watercraft. Since the control for making the decrease rate smaller is started immediately after the driver's operation for deceleration, the driver does not feel a slight acceleration state after a lapse of some time after the start of the deceleration. This makes it possible to provide a sufficiently long time period during which the watercraft is effectively steered without making the driver feel driving discomfort.

The above and further objects and features of the invention will more fully be apparent from the following detailed description with accompanying drawings.

DETAILED DESCRIPTION OF THE PREFERRED EMBODIMENTS

Hereinafter, embodiments of the present invention will be described with reference to the accompanying drawings.

Embodiment 1

Figure 1:
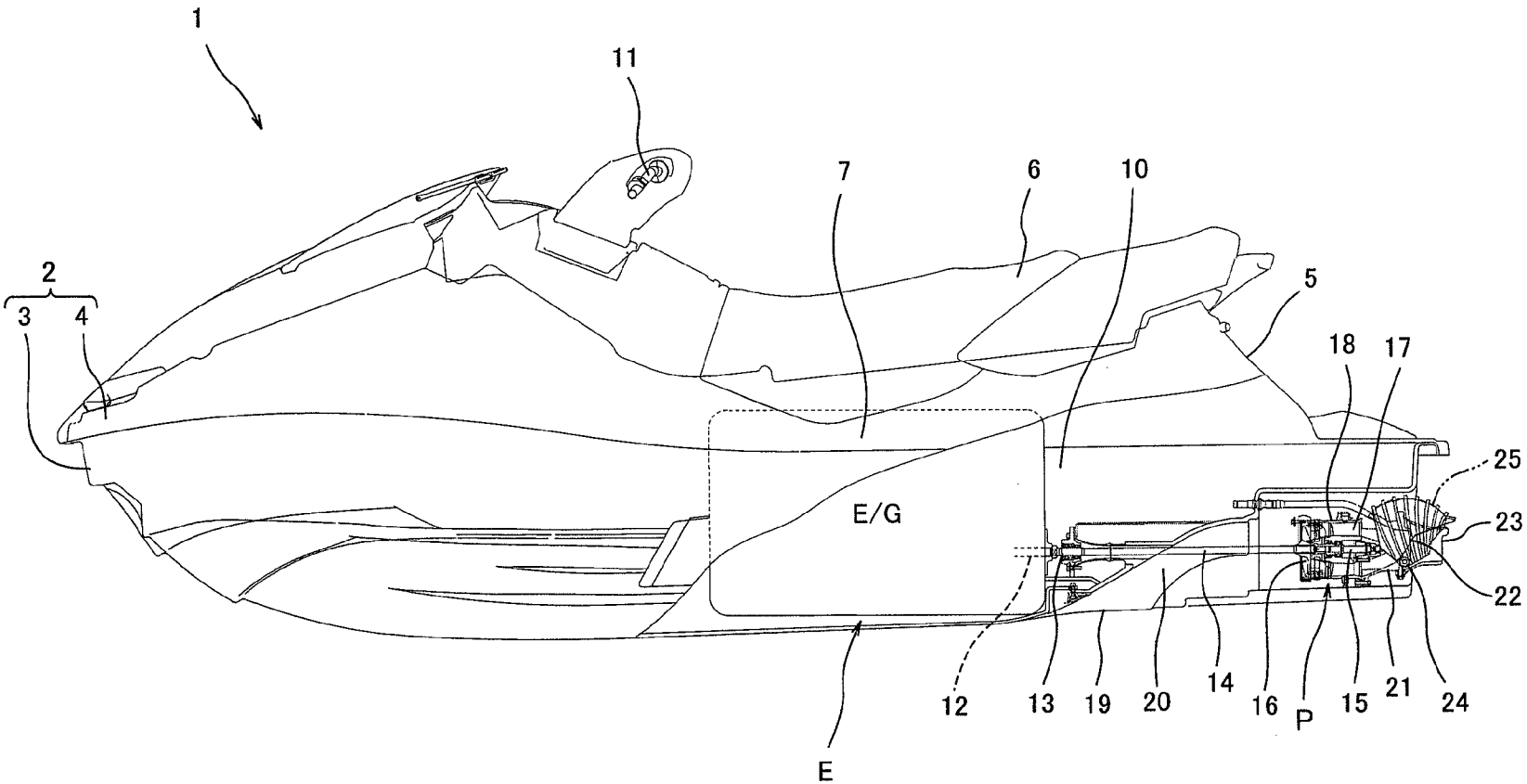
FIG. 1 is a partially cutaway side view of a jet-propulsion personal watercraft according to a first embodiment of the present invention, as seen from the left.

FIG. 1 is a partially cutaway side view of a jet-propulsion personal watercraft 1 as seen from the left. With reference to FIG. 1, the jet-propulsion personal watercraft 1 is a straddle-type jet-propulsion watercraft which is provided with a seat 6 straddled by a driver. A body 2 of the watercraft 1 comprises a hull 3 and a deck 4 covering the hull 3 from above. A center portion (protruding portion) 5 in a width direction of a rear part of the deck 4 protrudes upward. The seat 6 is mounted over an upper surface of the protruding portion 5. A deck floor 7 is formed on right and left sides in the width direction of the protruding portion 5 to be substantially flat and lower than the protruding portion 5 to enable a driver's feet to be put thereon.

A space defined by the hull 3 and the deck 4 below the seat 6 forms an engine room 10 which accommodates the engine E. The engine E is mounted in the engine room 10 in such a manner that a crankshaft 12 extends in a longitudinal direction of the body 2. An engine speed sensor 52 (see FIG. 4) which is a crank angle sensor is attached on the crankshaft 12. An ECU 50 (see FIG. 4) calculates a rotational angle of the crankshaft 12 based on a signal received from the engine speed sensor 52, thus detecting an engine speed of the engine E. In other words, the engine speed sensor 52 and the ECU 50 form a driving power output detector which is capable of detecting the engine speed.

An output end portion of the crankshaft 12 is coupled to a propeller shaft 14 via a coupling member 13. The propeller shaft 14 is coupled to a pump shaft 15 of a water jet pump P disposed at a rear part of the body 2. The pump shaft 15 is rotatable in association with the rotation of the crankshaft 12. An impeller 16 is attached on the pump shaft 15 and fairing vanes 17 are provided behind the impeller 16. A tubular pump casing 18 is provided on the outer periphery of the impeller 16 so as to contain the impeller 16.

A water intake 19 opens on a bottom region of the body 2. The water intake 19 is connected to the pump casing 18 through a water passage 20. The pump casing 18 is coupled to a pump nozzle 21 provided on the rear side of the body 2. The pump nozzle 21 has a cross-sectional area that gradually reduces rearward, and an outlet port 22 opens at a rear end of the pump nozzle 21. A steering nozzle 23 is coupled to the outlet port 22 of the pump nozzle 21 and is configured to be pivotable clockwise and counterclockwise.

Water outside the watercraft 1 is sucked from the water intake 19 on the bottom region of the hull 3 and fed to the water jet pump P. Driven by the engine E, the water jet pump P causes the impeller 16 to be rotated, thereby pressurizing and accelerating the water. The fairing vanes 17 guide water flow behind the impeller 16. Water jet is ejected rearward from the outlet port 22 of the pump nozzle 21 and through the steering nozzle 23. As the resulting reaction, the watercraft 1 obtains a propulsion force. A bowl-shaped reverse deflector 25 is provided on an upper portion of the steering nozzle 23 such that it is vertically pivotable around a horizontally mounted pivot shaft 24.

A bar-type steering handle 11 is disposed in front of the seat 6. A throttle lever (not shown) is mounted to a right grip of the steering handle 11. The throttle lever is an input device which is pivotable according to a gripping operation of the driver's right hand. The steering handle 11 is connected to the steering nozzle 23 through a steering cable (not shown). When the driver rotates the steering handle 11 clockwise or counterclockwise, the steering nozzle 23 is pivoted toward the opposite direction, so that the ejection direction of the water being ejected through the steering nozzle 23 can be changed, and the watercraft 1 can be correspondingly turned to any desired direction while the water jet pump P is generating the propulsion force.

Figure 2:
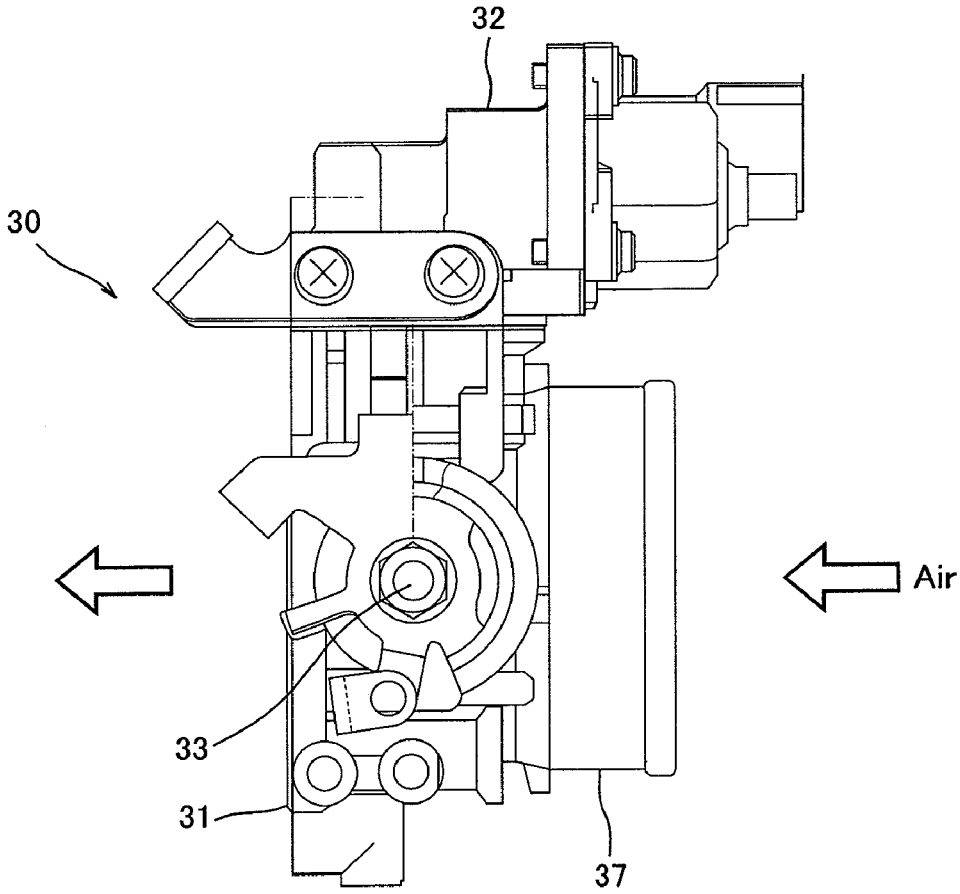
FIG. 2 is a side view of a throttle system mounted in the jet-propulsion personal watercraft of FIG. 1.
Figure 3:
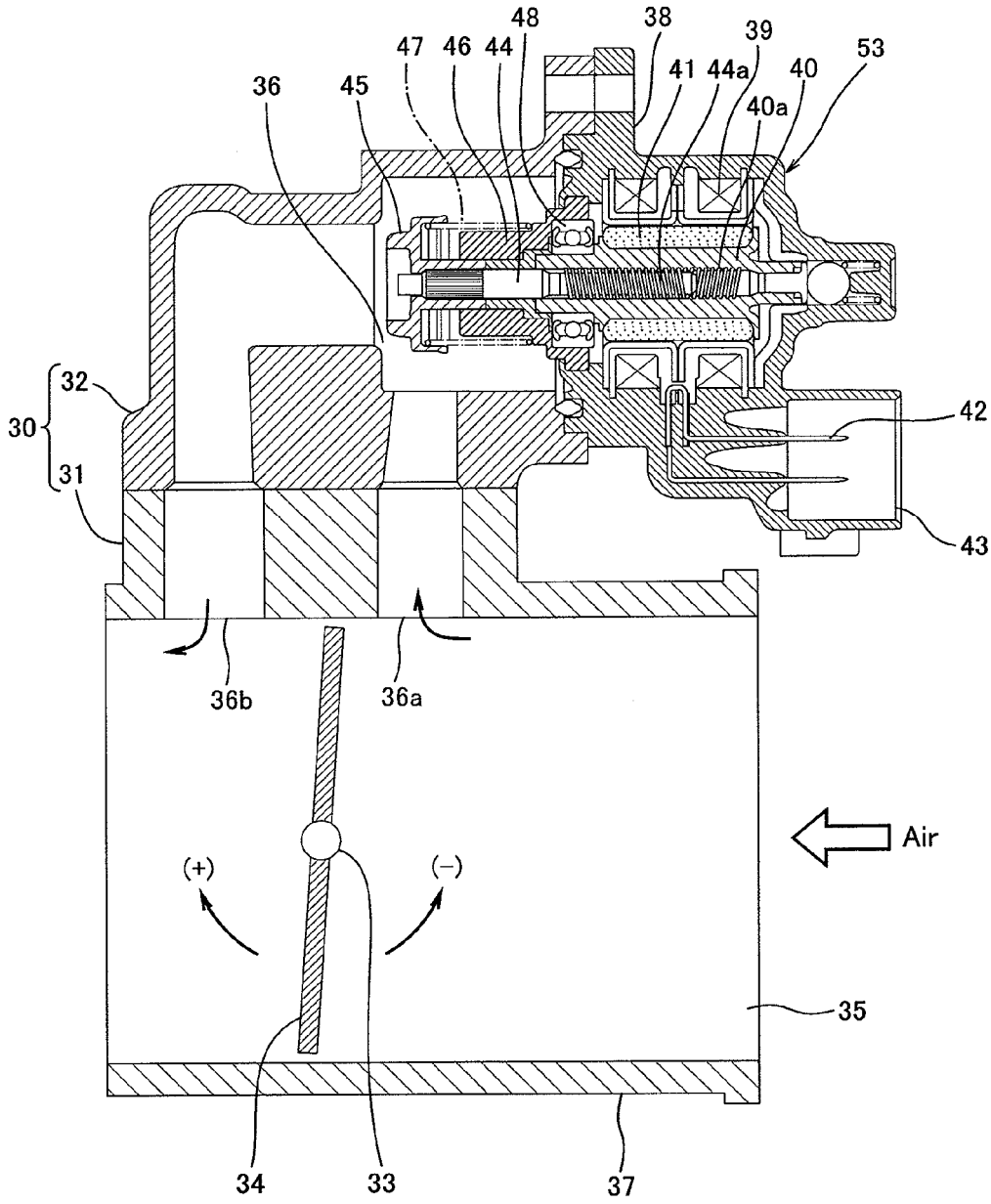
FIG. 3 is a cross-sectional view of the throttle system mounted in the jet-propulsion personal watercraft of FIG. 1.

FIG. 2 is a side view of a throttle system 30 mounted in the personal watercraft 1 of FIG. 1. FIG. 3 is a cross-sectional view of the throttle system 30 mounted in the watercraft 1 of FIG. 1. As shown in FIGS. 2 and 3, the throttle system (engine speed changing system) 30 includes a main throttle body 31 having a tubular air-intake portion 37 forming an air-intake passage 35 (see FIG. 3) therein and an idle control body 32. An upstream opening (right side in FIG. 3) of the tubular air-intake portion 37 of the main throttle body 31 is coupled to an air box (not shown), and a downstream opening (left side in FIG. 3) thereof is coupled to an intake manifold (not shown) of the engine E (FIG. 1). A throttle shaft 33 is rotatably disposed within the air-intake tubular portion 37. A disc-shaped throttle valve 34 is fixed on the throttle shaft 33 and is disposed in the air-intake passage 35 in the interior of the air-intake tubular portion 37.

The throttle shaft 33 is rotatable in association with the pivot operation of the throttle lever via a throttle wire (not shown), etc. The throttle valve 34 is opened and closed according to the driver's hand operation of the throttle lever. A return spring (not shown) is mounted to the throttle shaft 33 and is configured to apply a force to cause the throttle shaft 33 to return in a direction to close the throttle valve 34 in a state where a force resulting from the driver's hand operation of the throttle lever is not transmitted to the throttle shaft 33. A throttle position sensor 51 (FIG. 4) is coupled to the throttle shaft 33. The ECU 50 (see FIG. 4) calculates, based on a signal received from the throttle position sensor 51, a rotational angle of the throttle valve 34 which is rotatable integrally with the throttle shaft 33, thus detecting the rotational angle of the throttle valve 34. In other words, the throttle position sensor 51 and the ECU 50 form an input detector which is capable of detecting an operation position of the throttle lever. A fuel injector (not shown) is attached on the intake manifold to inject a fuel to the air which is taken in from outside and supplied to the engine E.

Turning to FIG. 3, the idle control body 32 forms a bypass passage 36 connected to the air-intake passage 35 in parallel so as to bypass the throttle valve 34. The bypass passage 36 has an inlet 36*a* connected to the air-intake passage 35 in a location upstream of the throttle valve 34 in the air flow direction and an outlet 36*b* connected to the air-intake passage 35 in a location downstream of the throttle valve 34. The idle control body 32 is provided with a bypass valve 45 which serves to increase or decrease a flow cross-sectional area of the bypass passage 36. The bypass valve 45 is attached with a bypass valve driving device 53 which causes the bypass valve 45 to be extended and retracted.

The bypass valve driving device 53 has a stator 38 forming an outer tube thereof. An armature coil 39 is mounted to an inner peripheral surface of the stator 38. The stator 38 is provided with a connector accommodating portion 43. A terminal 42 protrudes into the interior of the connector accommodating portion 43 and is electrically connected to the armature coil 39. A cylindrical rotor 40 is rotatably mounted in an inner space of the stator 38. A permanent magnet 41 is attached to an outer peripheral surface of the rotor 40 to be opposite to the armature coil 39. An internal threaded portion 40*a* is formed in a desired location of an inner peripheral surface of the rotor 40.

A drive shaft 44 is inserted into an inner space of the rotor 40. The bypass valve 45 is spline-coupled to a tip end portion of the drive shaft 44 on the bypass passage 36 side. An external threaded portion 44*a* is formed on an outer peripheral surface of the drive shaft 44 and is threadedly engaged with the internal threaded portion 40*a* of the rotor 40. A holder 46 is externally fitted to the rotor 40 by a bearing 48. The holder 46 is mounted on the stator 38 and is configured to guide the drive shaft 44 and the bypass valve 45. One end portion of the spring 47 is coupled to the holder 46 and an opposite end portion thereof is coupled to the bypass valve 45. In the bypass valve driving device 53 thus constructed, when a current flows in a desired amount in the armature coil 39, the rotor 40 rotates, causing the drive shaft 44 to be axially extended and retracted, because the internal threaded portion 40*a* and the external threaded portion 44*a* are threadedly engaged with each other. As a result, the bypass valve 45 mounted to the tip end portion of the drive shaft 44 operates to open or close the bypass passage 36 to increase or decrease the flow cross-sectional area of the bypass passage 36.

Figure 4:
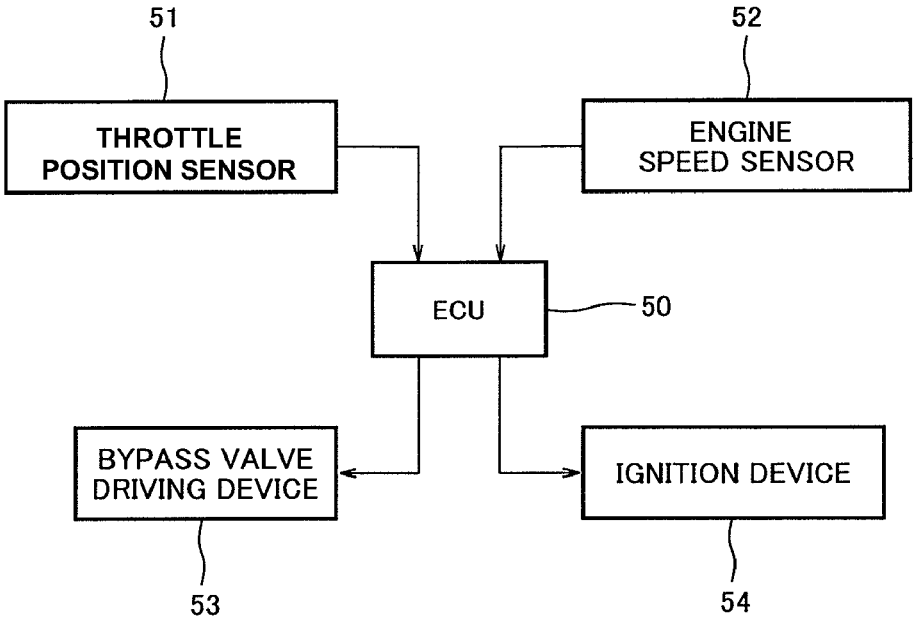
FIG. 4 is a block diagram showing an ECU (electronic control unit) and other components which are built into the jet-propulsion personal watercraft of FIG. 1.

FIG. 4 is a block diagram showing an ECU 50 and other components mounted in the watercraft 1 shown in FIG. 1. The ECU 50 serves as an engine controller and a determiner as described later. As shown in FIG. 4, the throttle position sensor 51 that detects the opening degree of the throttle valve 34 (FIG. 3), and the engine speed sensor 52 that detects the rotational angle of the crankshaft 12 (FIG. 1) of the engine E (FIG. 1) to thereby obtain the engine speed, are communicatively coupled to the ECU 50. In addition, the bypass valve driving device 53 for driving the bypass valve 45 (FIG. 3) which substantially opens and closes the bypass passage 36 (FIG. 3), and an ignition device 54 for igniting an air-fuel mixture in the engine E (FIG. 1) are communicatively coupled to the ECU 50. The ECU 50 is configured to control the bypass valve driving device 53 and the ignition device 54 based on a signal received from the throttle position sensor 51 and a signal received from the engine speed sensor 52.

Figure 5:
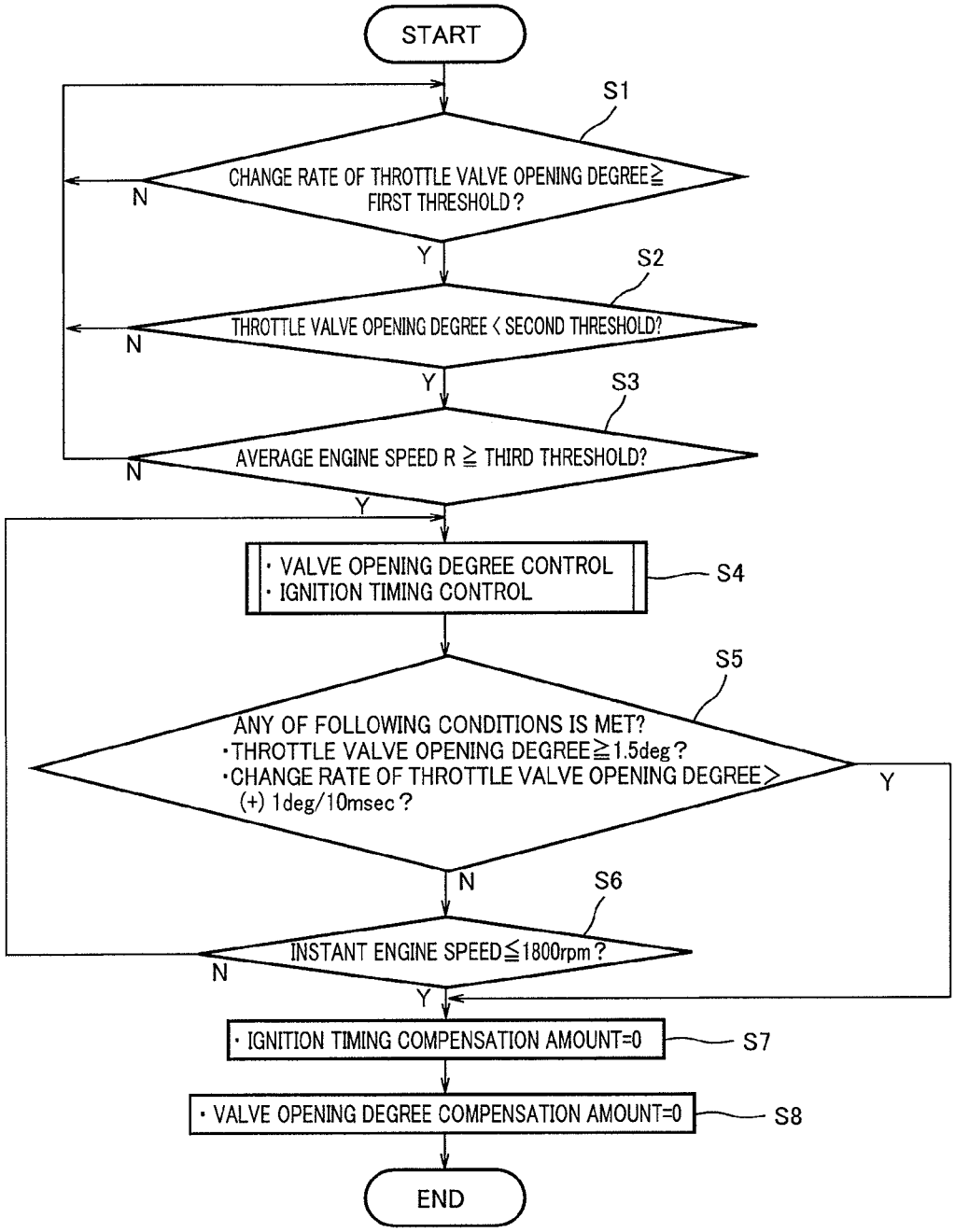
FIG. 5 is a flowchart showing a control for effectively steering the jet-propulsion personal watercraft of FIG. 1 in a deceleration state.

FIG. 5 is a flowchart showing a control executed to effectively steer the watercraft 1 of FIG. 1 in the deceleration state of the watercraft 1. As shown in FIG. 5, the ECU 50 (FIG. 4) determines whether or not the throttle lever has been quickly returned to an idling position corresponding to an idling engine speed and thereby a change rate of the opening degree of the throttle valve 34 has decreased rapidly such that the change rate of the throttle valve opening degree is not smaller than a first threshold (e.g., the change rate is (−5) deg/10 msec or smaller) (step S1). As used herein, to describe the change rate of the throttle valve opening degree, the minus sign (−) indicates that the throttle valve 34 rotates in the closing direction and the plus sign (+) indicates that the throttle valve 34 rotates in an opening direction.

If it is determined that the change rate of the throttle valve opening degree is smaller than the first threshold (N in step S1), the ECU 50 returns the process to step S1. On the other hand, if it is determined that the change rate of the throttle valve opening degree is not smaller than the first threshold (Y in step S1), the ECU 50 further determines whether or not the throttle valve opening degree which has been detected by the throttle position sensor 51 is smaller than a second threshold (e.g., 1 degree) and the throttle handle has been operated to close the throttle valve to decrease the engine speed so that a smaller propulsion force is generated (step S2). If it is determined that the throttle valve opening degree is not smaller than the second threshold (N in step S2), the ECU 50 returns the process to step S1. On the other hand, if it is determined that the throttle valve opening degree is smaller than the second threshold (Y in step S2), the ECU 50 further determines whether or not an average engine speed R at a time point of step S2 is not lower than a third threshold (e.g., 4375 rpm) (step S3). If the average engine speed R is not lower than the third threshold, then it is estimated that the watercraft 1 is driving at a speed higher than a certain speed, and therefore a speed of the water jet for generating the propulsion force is likely to be lower than a vehicle speed of the body 2 of the watercraft 1. To avoid this, the control for effectively steering the watercraft 1 is executed when the average engine speed R is not lower than the third threshold.

Figure 6:
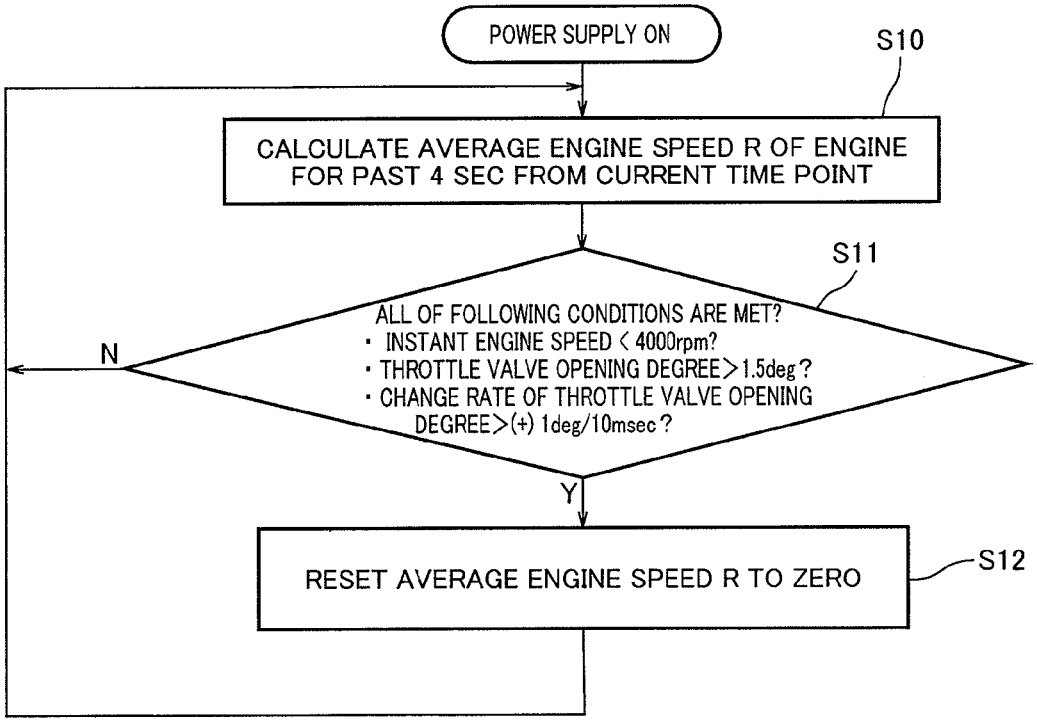
FIG. 6 is a flowchart showing calculation of an average engine speed of an engine mounted in the jet-propulsion personal watercraft of FIG. 1.

FIG. 6 is a flowchart showing calculation of the average engine speed R of the engine E of the watercraft 1 of FIG. 1. As shown in FIG. 6, when a power supply of the ECU 50 (see FIG. 4) is turned on, the ECU 50 continuously calculates the average engine speed R of the engine E for four seconds that have passed from a current time point (step S10). Then, the ECU 50 determines whether or not all of the following conditions (1) to (3) are met (step S11). This is because the speed of the water jet for generating the propulsion force is less likely to be slower than the vehicle speed of the body 2 of the watercraft 1 even under the state where the control for effectively steering the watercraft 1 is not executed, if the driver is operating the throttle lever to open or close the throttle valve repeatedly within a short time and thereby the vehicle speed of the watercraft 1 is relatively low.

Condition (1): Instant engine speed <4000 rpm

Condition (2): Throttle valve Opening Degree >1.5 deg

Condition (3): CHANGE RATE OF Throttle Valve Opening Degree >(+) 1 deg/10 msec

If it is determined that any one of the above identified conditions (1) to (3) is not met (N in step S11), the ECU 50 returns the process to step S10. On the other hand, if it is determined that all of the conditions (1) to (3) are met (Y in step S11), then the ECU 50 resets a value of the average engine speed R being calculated therein to zero so that step S3 in FIG. 5 is inhibited from transitioning to the control for effectively steering the watercraft 1 in step S4 (step S12), and returns the process to step S10. The ECU 50 is configured to continue calculating the average engine speed R shown in FIG. 6 during a time period when the power supply of the ECU 50 is in an on-state and to finish calculation as soon as the power supply is turned off.

Turning to step S3 in FIG. 5 again, if it is determined that the average engine speed R at the time point in step S2 is lower than the third threshold (e.g., 4375 rpm) (second detection) (N in step S3), the ECU 50 determines that the control for effectively steering the watercraft 1 should not be executed and returns the process to step S1, because the associated speed of the water jet for generating the propulsion force is less likely to be lower than the vehicle speed of the watercraft 1. On the other hand, if it is determined that the average engine speed R is not lower than the third threshold (e.g., 4375 rpm) (first detection) (Y in step S3), the ECU 50 executes valve opening degree control and ignition timing control in parallel as the control for effectively steering the watercraft 1 in the deceleration state, immediately after it is determined that the average engine speed R is not lower than the third threshold (step S4). Hereinafter, the valve opening degree control and the ignition timing control executed in step S4 will be described in detail separately.

Figure 7:
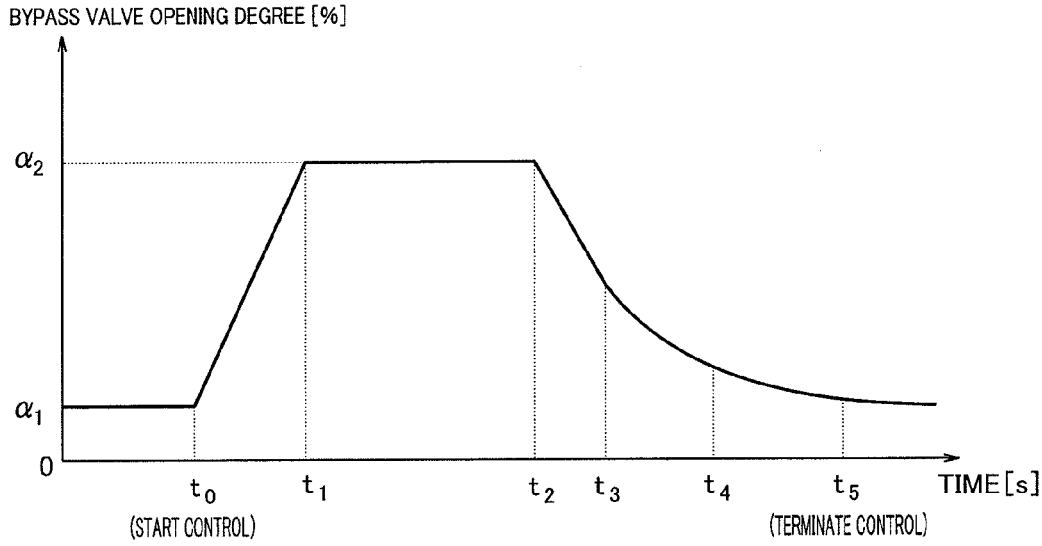
FIG. 7 is a graph showing a bypass valve opening degree which is associated with a valve opening degree control for the jet-propulsion personal watercraft of FIG. 1.

FIG. 7 is a graph showing the bypass valve opening degree which is associated with the valve opening degree control for the watercraft 1 of FIG. 1. In FIG. 7, the bypass valve opening degree is defined as follows: a fully closed position of the bypass valve 45 (FIG. 3) in the bypass passage 36 (FIG. 3) is 0% and a fully open position thereof is 100%. As shown in FIG. 7, the valve opening degree control is started at a time point to. Initially, the bypass valve opening degree is increased proportionally from $\alpha 1$ at a change rate of 0.83%/10 msec. Then, at a time point t1 when it is detected that the engine speed has been decreased to 3000 rpm (fourth threshold) and the bypass valve opening degree is $\alpha 2$, the bypass valve opening degree is feedback-controlled so as to maintain the engine speed at 3000 rpm thereafter. After a lapse of a time interval (t2−t1) during which the engine speed is maintained at 3000 rpm (e.g., t2−t0=800 msec), the bypass valve opening degree is decreased substantially proportionally at a change rate of 0.83%/30 msec.

From a time point t3 when the engine speed reaches slightly higher than an idling engine speed (e.g., 1300 rpm), for example, 1800 rpm, a tailing control is executed to gradually converge the bypass opening degree to an idling opening degree corresponding to an idling engine speed. At a time point t5 which is a time point slightly before the engine speed reaches the idling engine speed, the valve opening degree control is terminated and transitions to an idling mode. In this case, by setting the time point t5 when the valve opening degree control is terminated later than the time point t4 when the ignition timing control is terminated, the engine speed is inhibited from becoming lower than a suitable idling engine speed.

Figure 8:
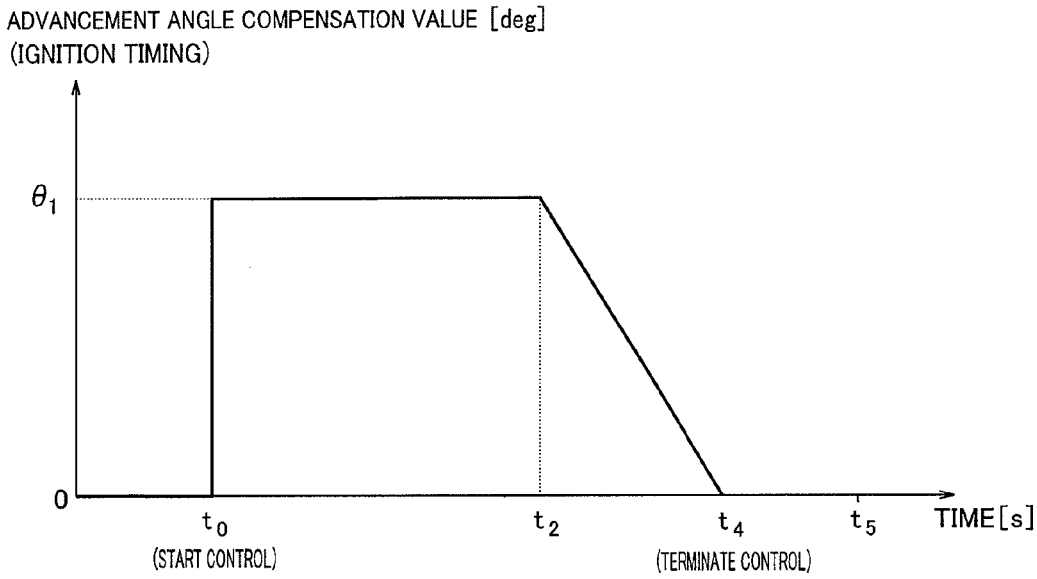
FIG. 8 is a graph showing an ignition timing which is associated with an ignition timing control for the jet-propulsion personal watercraft of FIG. 1.

FIG. 8 is a graph showing ignition timing associated with the ignition timing control for the watercraft 1 of FIG. 1. The engine speed generally increases with an increase in an advancement angle compensation value in FIG. 8. As shown in FIG. 8, the ignition timing control is started at the time point to. First, the advancement angle compensation value is increased from 0 degrees before the ignition timing control, to $\theta 1$ (e.g., 30 degrees). After a lapse of the time period (e.g., t2−t0=800 msec) during which the watercraft 1 is effectively steered, the advancement angle compensation value is decreased proportionally at a change rate of 1 deg/90 msec. Then, at the time point t4 when the advancement angle compensation value reaches zero, the ignition timing control is terminated.

Figure 9:
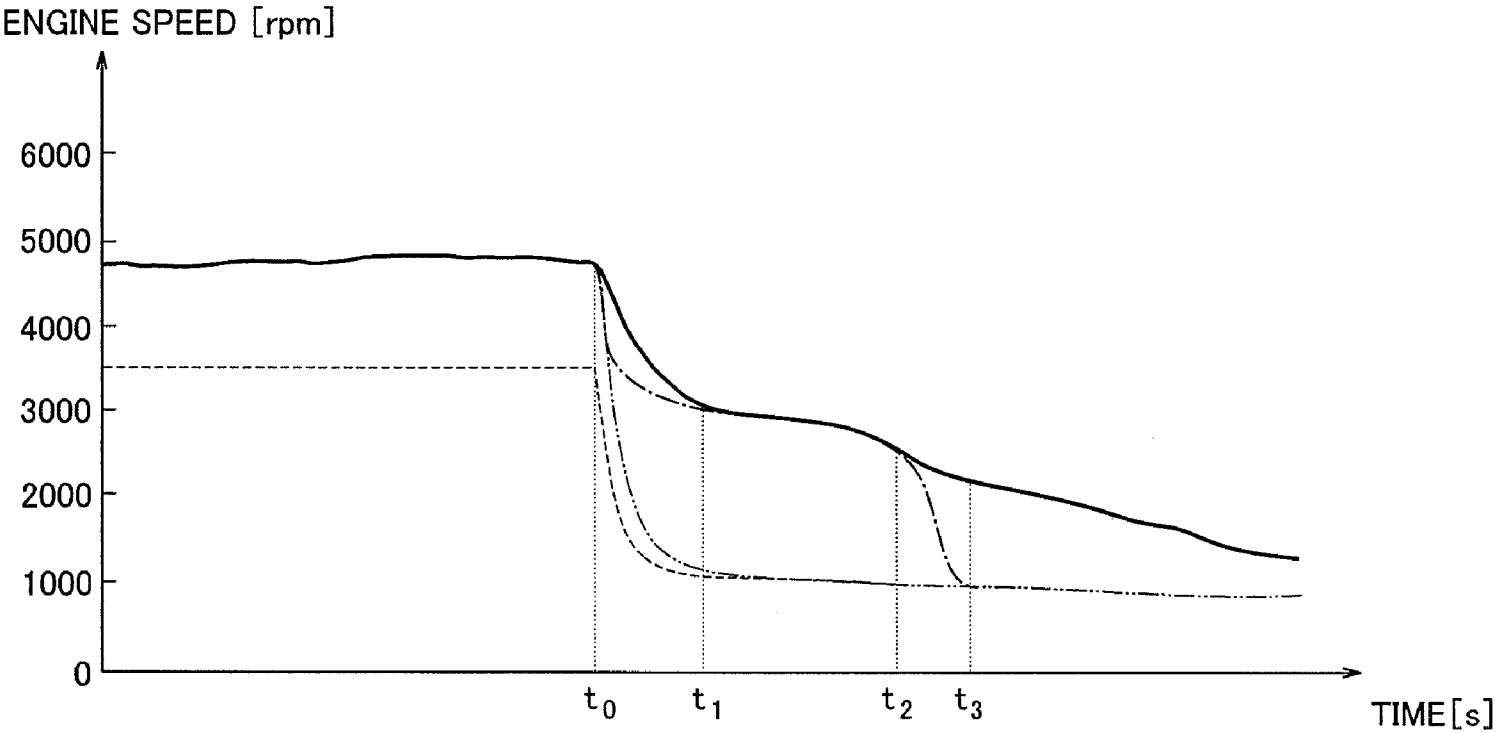
FIG. 9 is a graph showing an engine speed which is associated with the control for effectively steering the jet-propulsion personal watercraft of FIG. 1 in the deceleration state.

FIG. 9 is a graph showing an engine speed of the engine E which is associated with the control for effectively steering the watercraft 1 shown in FIG. 1. In FIG. 9 a solid line indicates a deceleration state under the state where the control for effectively steering the watercraft 1 of the present invention is executed, a two-dotted line indicates a deceleration under the state where the control for effectively steering the watercraft 1 is not executed, a one-dotted line indicates a deceleration state disclosed in U.S. Pat. Nos. 6,709,302 and 6,231,410, and a broken line indicates a detection state associated with the second detection. To be specific, the engine speed changes as indicated by the solid line in FIG. 9 when the control for effectively steering the watercraft 1 including the valve opening degree control (FIG. 7) and the ignition timing control (FIG. 8) is executed.

As shown in FIG. 9, in a time period from the time point t0 which is the time point of the first detection of the present invention to the time point t1, the engine speed decreases gradually at a change rate smaller than that of the engine speed under the state where the control for effectively steering the watercraft 1 is not executed. In other words, in the time period from the time point t0 to the time point t1, a decrease rate of the engine speed of the present invention is smaller than a decrease rate of the engine speed under the state where the control for effectively steering the watercraft 1 is not executed. Furthermore, for example, an average decrease rate of the engine speed for 0.3 second from the time point t0 (from the time point t0 to a time point between the time point t0 and the time point t1) which is associated with the first detection of the present invention is smaller than an average decrease rate of the engine speed for 0.3 second which is associated with the second detection.

In this case, since the increase rate (FIG. 7) of the bypass valve opening degree is decided so that the decrease rate of the engine speed from is inhibited from getting too small, the driver can feel an appropriate deceleration state. Thereafter, in order to increase a time period during which the watercraft 1 is effectively steered, the engine speed is maintained at approximately 3000 rpm from the time point t1 to the time point t2. After the time point t2, the engine speed gradually decreases and converges to the idling engine speed. In the manner described above, the control for effectively steering the watercraft 1, namely, the valve opening degree control and the ignition timing control, is executed in the deceleration state of the watercraft 1.

Turning to FIG. 5 again, while the valve opening degree control and the ignition timing control are executed in step S4, the ECU 50 determines whether or not the condition (4) or (5) is met to determine whether or not the driver has operated the throttle lever to accelerate the watercraft 1 (step S5).

Condition (4): Throttle valve opening degree ≧1.5 deg

Condition (5): Change Rate Of Throttle valve opening degree >(+) 1 deg/10 msec

If it is determined that the condition (4) or (5) is met, the ECU 50 moves the process to step S7 to forcibly terminate the control for effectively steering the watercraft 1 (valve opening degree control and the ignition timing control), because the speed of the water jet for generating the propulsion force is less likely to be slower than the vehicle speed of the body 2 of the watercraft 1, under the state where the control for effectively steering the watercraft 1 is not executed. On the other hand, if it is determined that none of the conditions (4) and (5) are met, the ECU 50 further determines whether or not the instant engine speed is not higher than 1800 rpm to determine a normal condition for terminating the control for effectively steering the watercraft 1 (valve opening degree control and ignition timing control) (step S6). If it is determined that the instant engine speed is higher than 1800 rpm in step 6 (N in step S6), the ECU 50 returns the process to step S4, and continues to execute the control for effectively steering the watercraft 1. On the other hand, if it is determined that the instant engine speed is not higher than 1800 rpm (Y in step S6), the ECU 50 sets an advancement angle compensation value associated with the ignition timing shown in FIG. 8 to zero, thus terminating the ignition timing control (step S7). In a short time after the termination of the ignition timing control, the valve opening degree control is terminated, and thus the control for effectively steering the watercraft 1 is terminated (step S8).

In accordance with the above described configuration, during driving of the watercraft 1, even when the driver is rotating the steering handle 11 (FIG. 1) to make the watercraft 1 to approach the position parallel to the shoreline while manipulating the throttle lever to the idling position to decrease the engine speed, the watercraft 1 is able to be effectively steered while obtaining a suitable propulsion force. To be specific, since the engine speed is controlled to be decreased gradually even when the throttle lever is operated to the idling position by the driver in the state where the watercraft 1 is driving, the water jet is ejected from the outlet port 22 (FIG. 1) of the pump nozzle 21 (FIG. 1) for a while to enable the watercraft 1 to move forward or backward or otherwise to turn. Therefore, the driver is able to effectively operate the steering handle 11 (FIG. 1) to pivot the steering nozzle 23 (FIG. 1) clockwise or counterclockwise, thereby changing the driving direction of the watercraft 1.

Furthermore, in a case where the watercraft 1 is turning while decelerating in a state where the watercraft 1 is driving at a high speed, the bypass valve 45 is controlled so that the decrease rate of the engine speed immediately after the driver's operation for the deceleration becomes smaller than the decrease rate in a case where the watercraft 1 is decelerated from a low-speed driving state. This makes it possible to provide a sufficiently long time period during which the watercraft 1 is effectively steered in the deceleration state, while enabling the driver to feel that the watercraft is smoothly decelerated from a high-speed driving state. The above illustrated numeric values are merely exemplary and may be selected according to the specification of the body 2 or the engine E, etc. Whereas in the first embodiment, the bypass valve opening is increased upon starting the valve opening degree control, it may alternatively be controlled to be maintained.

Whereas in the first embodiment, both the valve opening degree control and the ignition timing control are used as the control for effectively steering the watercraft 1, only one of them may be used.

Embodiment 2

Figure 10:
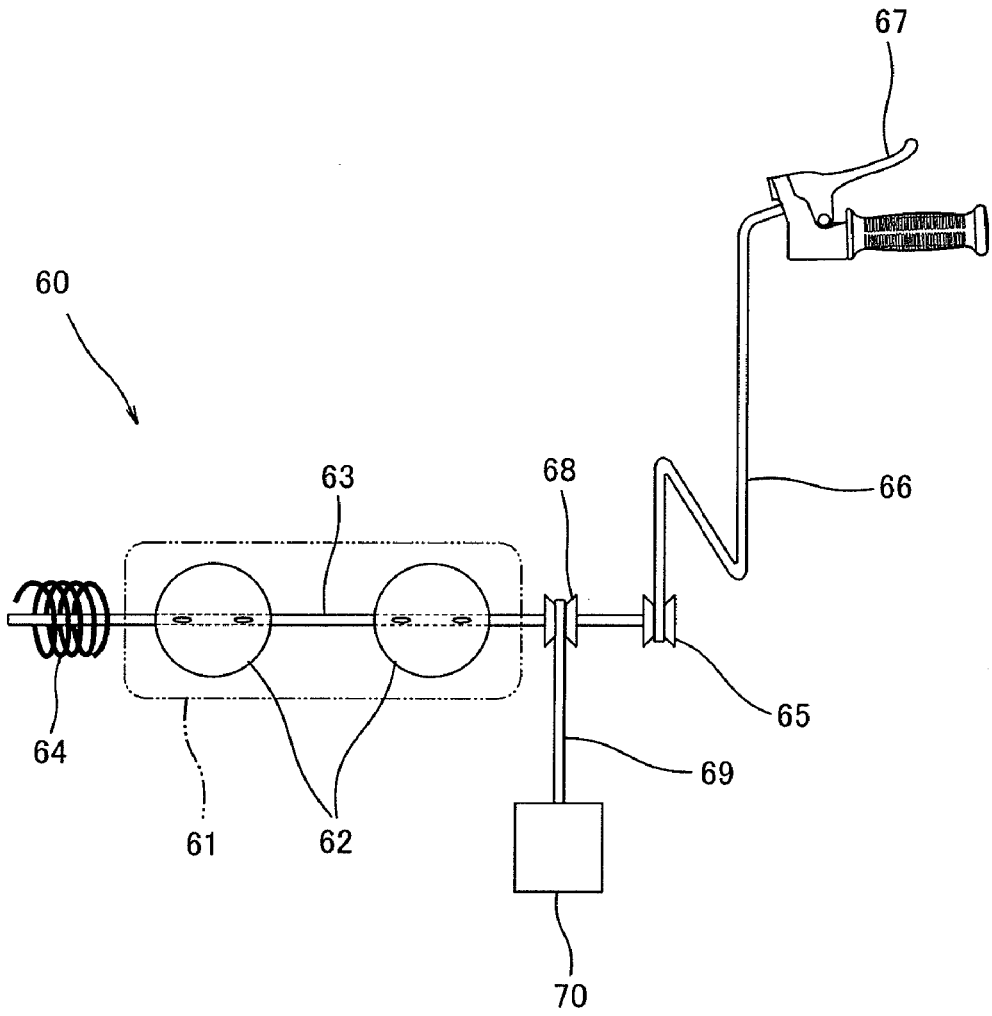
FIG. 10 is a view schematically showing a throttle system of a jet-propulsion personal watercraft according to a second embodiment of the present invention.

A second embodiment will now be described. In the second embodiment, the same reference numerals as those of the first embodiment are used to denote the same or corresponding components which will not be further described. FIG. 10 is a schematic view of a throttle system 60 in a jet-propulsion personal watercraft according to a second embodiment of the present invention. As shown in FIG. 10, the throttle system 60 includes a known throttle body 61 configured to control an amount of air taken in from outside and supplied to the engine E (see FIG. 1) by opening and closing butterfly throttle valves 62. The bypass valve in the first embodiment is omitted in the throttle system 60 in the second embodiment. The throttle valves 62 are fixed to a rotatable throttle shaft 63. A return spring 64 is mounted on one end portion of the throttle shaft 63 and is configured to apply a force to return the throttle shaft 63 in a direction to close the throttle valves 62 in a state where a force resulting from the driver's hand operation of a throttle lever 67 is not transmitted to the throttle shaft 63. A first pulley 65 is attached to an opposite end portion of the throttle shaft 63. A throttle cable 66 which operates in association with a pivot operation of the throttle lever 67 (input device) is coupled to the first pulley 65. When the driver rotates the throttle lever 67, the rotation is transmitted via the first pulley 65, causing the throttle shaft 63 to be rotated. A second pulley 68 is attached to the throttle shaft 63 in a desired position. A sub-cable 69 is coupled to the second pulley 68 and is driven to be extended and retracted by an actuator 70. The actuator 70 is able to apply to the throttle shaft 63 the force in a direction to open the throttle valves 62.

Figure 11:
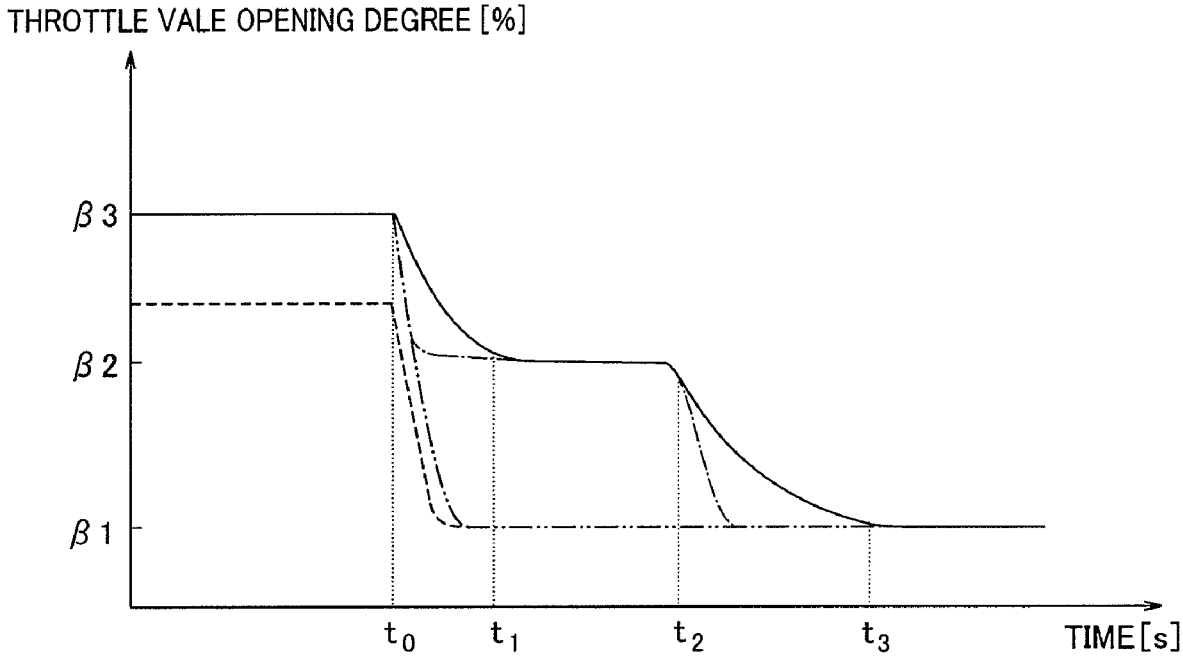
FIG. 11 is a graph showing a throttle valve opening degree which is associated with a valve opening degree control for the jet-propulsion personal watercraft of FIG. 10 in the deceleration state.

FIG. 11 is a graph showing a throttle valve opening degree which is associated with valve opening degree control for the throttle system of FIG. 10 in the deceleration state of the watercraft 1. In FIG. 11, a solid line indicates a throttle valve opening degree in a case where the control for effectively steering the watercraft 1 is executed, when the first detection occurs, a two-dotted line indicates a throttle valve opening degree in a case where the control for effectively steering the watercraft 1 is not executed, a one-dotted line indicates a throttle valve opening degree disclosed in U.S. Pat. Nos. 6,709,302 and 6,231,410, and a broken line indicates a throttle valve opening degree which is associated with the second detection.

As shown in FIG. 11, in a time period from the time point to which is the time point of the first detection of the present invention to the time point t1, the actuator 70 applies to the throttle shaft 63 the force in the direction to open the throttle valves 62 so that the throttle valve opening degree is decreased more gradually than the throttle valve opening degree is decreased under the state where the throttle shaft 63 is subjected to the force applied from the return spring 64. In other words, in the time period from the time point t0 to the time point t1, a decrease rate of the throttle valve opening degree of the present invention is smaller than a decrease rate of the throttle valve opening degree which is not subjected to the valve opening degree control. For example, an average decrease rate of the throttle valve opening degree for 0.3 second from the time point to (from the time point t0 to a time point between the time point t0 and the time point t1) which is associated with the first detection of the present invention is smaller than an average decrease rate of the throttle valve opening degree for 0.3 second which is associated with the second detection. Thereafter, in order to increase the time period during which the watercraft 1 is effectively steered, the ECU 50 feed-back controls the actuator 70 so that the engine speed is maintained at approximately 3000 rpm from the time point t1 to the time point t2. After the time point t2, the ECU 50 controls the actuator 70 so that the throttle valve opening degree is gradually decreased and converges to an idling opening degree corresponding to an idling engine speed.

In accordance with the above described configuration, as in the first embodiment, during driving of the watercraft 1, even when the driver is rotating the steering handle 11 (FIG. 1) to make the watercraft 1 to approach the position parallel to the shoreline while manipulating the throttle lever 67 to the idling position to decrease the engine speed, the watercraft 1 is able to be effectively steered while obtaining a suitable propulsion force. To be specific, since the engine speed is controlled to be decreased gradually even when the throttle lever 67 is operated to the idling position by the driver in the state where the watercraft 1 is driving, water jet is ejected from the outlet port 22 (FIG. 1) of the pump nozzle 21 (FIG. 1) for a while to enable the watercraft 1 to move forward or backward or otherwise to turn. Therefore, the driver is able to effectively operate the steering handle 11 (FIG. 1) to pivot the steering nozzle 23 (FIG. 1) clockwise or counterclockwise, thereby changing the driving direction of the watercraft 1. Furthermore, in a case where the watercraft 1 is decelerated in a state where the watercraft 1 is driving at a high speed, the engine speed changing system is controlled so that the decrease rate of the engine speed immediately after the driver's operation for deceleration becomes smaller than the decrease rate in a case where the watercraft 1 is decelerated from a low-speed driving state. This makes it possible to provide a sufficiently long time period during which the watercraft is effectively steered in the deceleration state, while enabling the driver to feel that the watercraft is smoothly decelerated from the high-speed driving state. The other configuration is identical to that of the first embodiment, and will not be further described.

The engine speed sensor used as the driving power output detector in the above embodiments may be replaced by a vehicle speed sensor for detecting a vehicle speed of the body 2. The throttle position sensor used as the input detector in the above embodiments may be replaced by an input detector built into the ECU, which is a program for detecting an operated state of the throttle lever by indirectly estimating a throttle operation amount with reference to values of the engine speed detected by the engine speed sensor. Instead of rotating the throttle valve in association with the pivot operation of the throttle lever via the throttle wire or the like, as illustrated in the above embodiments, the opening degree of the throttle valve may be electronically controlled by an actuator such as a motor based on the operation amount of the throttle lever which is detected by the sensor.

Throughout this specification and claims, where the term "immediately" is used to reference periods of time, it will be appreciated that the term is used to identify a period of time that is near or close by to the point of reference (such as the next following or next preceding period of time), but this term is not used to mean that no time intervenes between the point of reference and the referenced period of time, since ECU processing, actuation of mechanical components, combustion, etc., all consume some amount of time even if small, and thus it is very difficult to perform an action in an electromechanical system "immediately without any intervening interval of time".

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A jet-propulsion personal watercraft comprising:

an engine which is configured to generate a driving power for generating a propulsion force to propel the watercraft;

an engine speed changing system which is configured to be able to change an engine speed of the engine;

a determiner configured to determine whether or not to execute a control for effectively steering the watercraft at a start of deceleration of the watercraft; and an engine controller configured to control the engine speed changing system based on information received from the determiner;

wherein the engine controller is configured to, when the determiner determines that the control for effectively steering the watercraft should be executed, control the engine speed changing system to output a command to lower the decrease rate of the engine speed;

wherein the determiner includes an input detector which is configured to be able to detect an operated state of an input device with which a driver performs an operation to increase or decrease the engine speed, and a driving power output detector configured to be able to detect a driving power output of the watercraft;

wherein in a first detection, the input detector detects that the input device has been operated by the driver in a direction to decrease the engine speed, with a change rate which is not smaller than a first threshold, up to a position which is smaller than a second threshold, and the driving power output detector detects that the driving power output is not smaller than a third threshold;

wherein in a second detection, the input detector detects that the input device has been operated by the driver in the direction to decrease the engine speed, with the change rate which is not smaller than the first threshold up to the position smaller than the second threshold, and the driving power output detector detects that the driving power output is smaller than the third threshold; and wherein the determiner determines that the control for effectively steering the watercraft should not be executed when the second detection occurs and that the control for effectively steering the watercraft should be executed when the first detection occurs.

2. A jet-propulsion personal watercraft comprising:

an engine which is configured to generate a driving power for generating a propulsion force to propel the watercraft;

an engine speed changing system which is configured to be able to change an engine speed of the engine;

a determiner configured to determine whether or not to execute a control for effectively steering the watercraft at a start of deceleration of the watercraft; and an engine controller configured to control the engine speed changing system based on information received from the determiner;

wherein the engine controller is configured to, when the determiner determines that the control for effectively steering the watercraft should be executed, control the engine speed changing system to output a command to lower the decrease rate of the engine speed; and wherein the engine controller is configured to control the engine speed changing system so that an average decrease rate of the engine speed for 0.3 seconds immediately after the determiner determines that the control for effectively steering the watercraft should be executed is smaller than an average decrease rate of the engine speed for 0.3 seconds immediately after the determiner determines that the control for effectively steering the watercraft should not be executed.

3. A jet-propulsion personal watercraft comprising:

an engine which is configured to generate a driving power for generating a propulsion force to propel the watercraft;

an engine speed changing system which is configured to be able to change an engine speed of the engine;

a determiner configured to determine whether or not to execute a control for effectively steering the watercraft at a start of deceleration of the watercraft; and an engine controller configured to control the engine speed changing system based on information received from the determiner;

wherein the engine controller is configured to, when the determiner determines that the control for effectively steering the watercraft should be executed, control the engine speed changing system to output a command to lower the decrease rate of the engine speed; and wherein the engine controller is configured to control the engine speed changing system so that an average decrease rate of the engine speed in a time period from immediately after the determiner determines that the control for effectively steering the watercraft should be executed until the engine speed reaches 3000 rpm or lower is smaller than an average decrease rate of the engine speed for 0.3 seconds immediately after the determiner determines that the control for effectively steering the watercraft should not be executed.

4. A jet-propulsion personal watercraft comprising:

an engine which is configured to generate a driving power for generating a propulsion force to propel the watercraft;

an engine speed changing system which is configured to be able to change an engine speed of the engine;

a determiner configured to determine whether or not to execute a control for effectively steering the watercraft at a start of deceleration of the watercraft; and an engine controller configured to control the engine speed changing system based on information received from the determiner;

wherein the engine controller is configured to, when the determiner determines that the control for effectively steering the watercraft should be executed, control the engine speed changing system to output a command to lower the decrease rate of the engine speed; and wherein the engine controller is configured to control the engine speed changing system to set a time interval during which the decrease rate of the engine speed is maintained to be smaller than a decrease rate of the engine speed immediately after the determiner determines that the control for effectively steering the watercraft should be executed, when the driving power output detector detects that the engine speed is decreased to a fourth threshold higher than an idling engine speed from a time point when the determiner determines that the control for effectively steering the watercraft should be executed.

5. The jet-propulsion personal watercraft according to claim 4, wherein the engine controller is configured to control the engine speed changing system so that a decrease rate of the engine speed immediately after a lapse of the time interval is smaller than a decrease rate of the engine speed immediately after the determiner determines that the control for effectively steering the watercraft should not be executed.

6. A jet-propulsion personal watercraft comprising:

an engine which is configured to generate a driving power for generating a propulsion force to propel the watercraft;

an engine speed changing system which is configured to be able to change an engine speed of the engine;

a determiner configured to determine whether or not to execute a control for effectively steering the watercraft at a start of deceleration of the watercraft; and an engine controller configured to control the engine speed changing system based on information received from the determiner;

wherein the engine controller is configured to, when the determiner determines that the control for effectively steering the watercraft should be executed, control the engine speed changing system to output a command to lower the decrease rate of the engine speed;

wherein the engine speed changing system includes an air-intake passage through which air taken in from outside is guided to the engine, a throttle valve configured to substantially open and close the air-intake passage based on an operation amount of an input device, a bypass passage connected to the air-intake passage so as to bypass the throttle valve, a bypass valve configured to substantially open and close the bypass passage, and a bypass valve driving device configured to drive the bypass valve; and wherein the engine controller is configured to execute valve opening degree control for causing the bypass valve driving device to increase or maintain an opening degree of the bypass valve immediately after the determiner determines that the control for effectively steering the watercraft should be executed.

7. The jet-propulsion personal watercraft according to claim 6, further comprising:

an engine speed sensor configured to detect an engine speed of the engine;

wherein the engine controller is configured to cause the bypass valve driving device to gradually increase the opening degree of the bypass valve immediately after the determiner determines that the control for effectively steering the watercraft should be executed, then to execute a feedback control for the opening degree of the bypass valve for a specified time period to maintain the engine speed detected by the engine speed sensor at a predetermined value, and then to cause the bypass valve driving device to gradually decrease the opening degree of the bypass valve.

8. A jet-propulsion personal watercraft comprising:

an engine which is configured to generate a driving power for generating a propulsion force to propel the watercraft;

an engine speed changing system which is configured to be able to change an engine speed of the engine;

a determiner configured to determine whether or not to execute a control for effectively steering the watercraft at a start of deceleration of the watercraft; and an engine controller configured to control the engine speed changing system based on information received from the determiner;

wherein the engine controller is configured to, when the determiner determines that the control for effectively steering the watercraft should be executed, control the engine speed changing system to output a command to lower the decrease rate of the engine speed;

wherein the engine speed changing system includes an air-intake passage through which air taken in from outside is guided to the engine, a throttle valve configured to substantially open and close the air-intake passage based on an operation amount of an input device, and an actuator configured to apply to the throttle valve a force in a direction to open the throttle valve; and wherein the engine controller is configured to execute valve opening degree control for causing the actuator to apply to the throttle valve the force in the direction to open the throttle valve immediately after the determiner determines that the control for effectively steering the watercraft should be executed.

9. The jet-propulsion personal watercraft according to claim 6, wherein the engine speed changing system further includes an ignition device configured to ignite an air-fuel mixture in the engine;

wherein the engine controller is configured to execute ignition timing control for increasing an advancement angle value of igniting timing of the ignition device immediately after the determiner determines that the control for effectively steering the watercraft should be executed; and wherein the engine controller is configured to terminate the valve opening degree control later than the ignition timing control is terminated.

10. The jet-propulsion personal watercraft according to claim 9, wherein the engine controller is configured to gradually decrease the advancement angle value after a lapse of a specified time period after increasing the advancement angle value of the ignition timing of the ignition device immediately after the determiner determines that the control for effectively steering the watercraft should be executed.

11. The jet-propulsion personal watercraft according to claim 1, wherein the engine speed changing system includes an air-intake passage through which air taken in from outside is guided to the engine, and a throttle valve configured to substantially open and close the air-intake passage based on an operation amount of the input device;

wherein the input detector includes a throttle position sensor configured to detect an opening degree of the throttle valve; and wherein the first threshold is a value indicating that the opening degree of the throttle valve detected by the throttle position sensor is changing at a rate of 5 degrees per 10 milliseconds in a direction to decrease the engine speed.

12. The jet-propulsion personal watercraft according to claim 1, wherein the engine speed changing system includes an air-intake passage through which air taken in from outside is guided to the engine, and a throttle valve configured to substantially open and close the air-intake passage based on an operation amount of the input device;

wherein the input detector includes a throttle position sensor configured to detect an opening degree of the throttle valve; and wherein the second threshold is a value indicating that the opening degree of the throttle valve detected by the throttle position sensor is 1 degree.

13. The jet-propulsion personal watercraft according to claim 1, wherein the driving power output detector includes an engine speed sensor configured to detect an engine speed of the engine; and wherein the third threshold is a value indicating that an average engine speed of the engine is 4375 rpm.

14. The jet-propulsion personal watercraft according to claim 13, wherein the average engine speed is an average value of the engine speed detected by the engine speed sensor which is obtained for 4 seconds that have passed from a current time point.

15. The jet-propulsion personal watercraft according to claim 1, wherein the engine speed changing system includes an air-intake passage through which air taken in from outside is guided to the engine, and a throttle valve configured to substantially open and close the air-intake passage based on an operation amount of the input device;

wherein the input detector includes a throttle position sensor configured to detect an opening degree of the throttle valve;

wherein the driving power output detector includes an engine speed sensor configured to detect an engine speed of the engine; and wherein the determiner determines that the control for effectively steering the watercraft should not be executed, when the engine speed detected by the engine speed sensor is lower than 4000 rpm, the opening degree of the throttle valve detected by the throttle position sensor is larger than 1.5 degrees, and a change rate of the opening degree of the throttle valve is larger than a change rate with which the opening degree of the throttle valve changes at a rate of 1 degree per 10 milliseconds in a direction to increase the engine speed.

16. A jet-propulsion personal watercraft comprising:

an engine which is configured to generate a driving power for generating a propulsion force to propel the watercraft;

an air-intake passage through which air taken in from outside is guided to the engine;

a throttle valve configured to substantially open and close the air-intake passage;

a bypass passage connected to the air-intake passage so as to bypass the throttle valve;

a bypass valve configured to substantially open and close the bypass passage;

a bypass valve driving device configured to drive the bypass valve;

a determiner configured to determine whether or not to execute a control for effectively steering the watercraft at a start of deceleration of the watercraft;

an engine controller configured to control the bypass valve driving device based on information received from the determiner; and an ignition device configured to ignite an air-fuel mixture in the engine;

wherein the engine controller is configured to, when the determiner determines that the control for effectively steering the watercraft should be executed, cause the bypass valve driving device to increase or maintain the opening degree of the bypass valve immediately after the determination; and wherein the engine controller is configured to execute ignition timing control for increasing an advancement angle value of ignition timing of the ignition device, immediately after the determiner determines that the control for effectively steering the watercraft should be executed.

* * * * *